United States Patent [19]

Stinebaugh

[11] Patent Number: 4,708,107

[45] Date of Patent: Nov. 24, 1987

[54] COMPACT PRESSURE-BOOSTED INTERNAL COMBUSTION ENGINE

[76] Inventor: Donald E. Stinebaugh, 2320 N. Corbin Rd., Post Falls, Id. 83854

[21] Appl. No.: 766,908

[22] Filed: Aug. 15, 1985

[51] Int. Cl.[4] ..... F02B 75/02; F02B 75/24

[52] U.S. Cl. ..... 123/317; 123/56 AA; 123/DIG. 6; 123/318

[58] Field of Search ..... 123/195 R, 317, 318, 123/DIG. 6, DIG. 7, 56 R, 56 A, 56 AA

[56] References Cited

U.S. PATENT DOCUMENTS

| | | | |
|---|---|---|---|
| 931,976 | 8/1909 | Turner | 123/317 |
| 3,561,416 | 2/1971 | Kiekhaefer | 123/195 R |
| 3,756,206 | 9/1973 | Gommel | 123/317 |
| 3,973,532 | 8/1976 | Litz | 123/317 |

FOREIGN PATENT DOCUMENTS

| | | | |
|---|---|---|---|
| 30475 | 8/1910 | United Kingdom | 123/317 |

OTHER PUBLICATIONS

Angle; "Lafleur"; 1/1939; p. 446 of Aerosphere.

*Primary Examiner*—Craig R. Feinberg
*Attorney, Agent, or Firm*—Dellett, Smith-Hill & Bedell

[57] ABSTRACT

A combustible mixture is compressed in the crankcase of a four-stroke cycle engine and forced into a boost plenum which houses the camshaft. The compressed mixture is metered by a throttle to intake valves of the engine. The engine is constructed from identical engine block elements rotated and joined to enclose the centrally disposed crankcase and common boost plenum with the cylinders horizontally opposed.

6 Claims, 9 Drawing Figures

COMPACT PRESSURE-BOOSTED INTERNAL COMBUSTION ENGINE

BACKGROUND OF THE INVENTION

This invention relates to internal combustion engines, and particularly to compact, pressureboosted engines.

Small power plants, for example, those used in ultralight aircraft, are typically two-stroke cycle engines of 15 to 40 brake horsepower and weighing 25 to 60 pounds (11 to 27 kilograms). When compared with four-stroke cycle engines, two-stroke cycle engines are characterized by low reliability and high fuel consumption. Further, two-stroke cycle engines develop effective power only at high crankshaft speeds, thus requiring a mechanical reduction system for a direct-drive output device such as a propeller. Such reduction systems add considerable weight and mechanical complexity to the power plant.

An object of the invention is to provide an improved, light-weight internal combustion engine having a four-stroke cycle and internal pressure boosting.

A further object of the invention is to provide a single, light-weight hemiblock element facilitating the manufacture of a variety of single and multicylinder embodiments of a pressure-boosted internal combustion engine.

Another object of the invention is to provide an improved internal combustion engine having an induction system providing efficient lubrication of internal engine parts.

Another object of the invention is to provide an improved internal combustion engine having a unique, light-weight hemiblock element which incorporates a common boost plenum in multicylinder embodiments.

Yet another object of the invention is to provide an improved light-weight, four-stroke cycle internal combustion engine having internal pressure boosting and efficient flow of working fluid for improved lubrication and cooling.

SUMMARY OF THE INVENTION

In accordance with one embodiment of the present invention, there is provided a twocylinder, four-stroke cycle internal combustion engine constructed of two identical hemiblock elements rotated 180 degrees with respect to each other and joined to form a centrally disposed, enclosed crankcase intermediate the two opposed cylinders. The hemiblock elements also join to form a common boost plenum centrally disposed alongside the crankcase and the bottom portions of the cylinders; the boost plenum houses a centrally disposed camshaft and inlet and exhaust valve actuating mechanisms. A combustible mixture is introduced into the crankcase on each upstroke of the pistons through a set of reed valve members horizontally disposed along the crankcase. A second set of reed valve members is disposed betwee the crankcase and the boost plenum. On each downstroke of the pistons the combustible mixture is compressed in the crankcase and forced into the boost plenum. The compressed combustible mixture is introduced into the combustion chambers of the cylinders from the boost plenum under control of throttle valves on alternate downstrokes of each piston.

In accordance with an alternative embodiment of the invention, a one-cylinder engine utilizes one hemiblock element and a closure separately enclosing the crankcase and the boost plenum.

BRIEF DESCRIPTION OF THE DRAWING

While the invention is set forth with particularity in the appended claims, other objects, features, the organization and method of operation of the invention will become more apparent, and the invention will best be understood by referring to the following detailed description in conjunction with the accompanying drawing in which:

Figure 1:
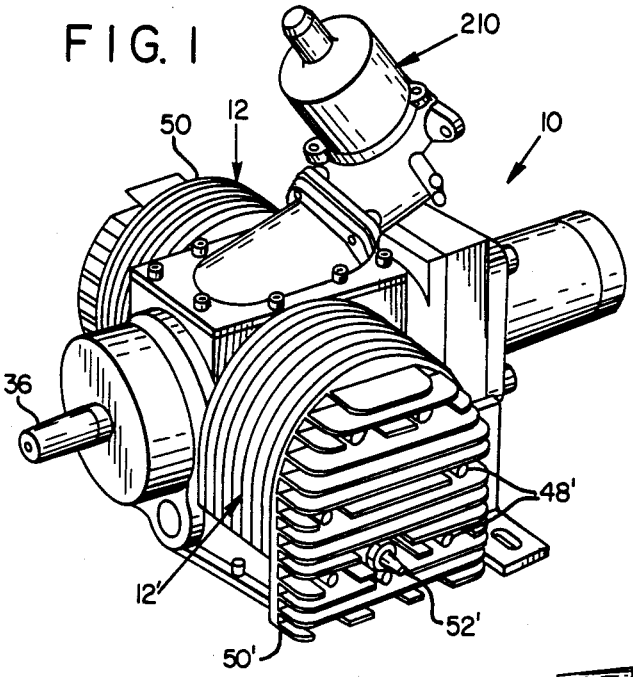
FIG. 1 is a pictorial view of one embodiment of an internal combustion engine in accordance with the present invention.

A conventional utilized in the ensuing description makes parenthetical reference to drawing figures for momentary referral thereto, the description then returning to the drawing figure(s) initially cited in the passage.

DESCRIPTION OF THE PREFERRED EMBODIMENT

Figure 4:
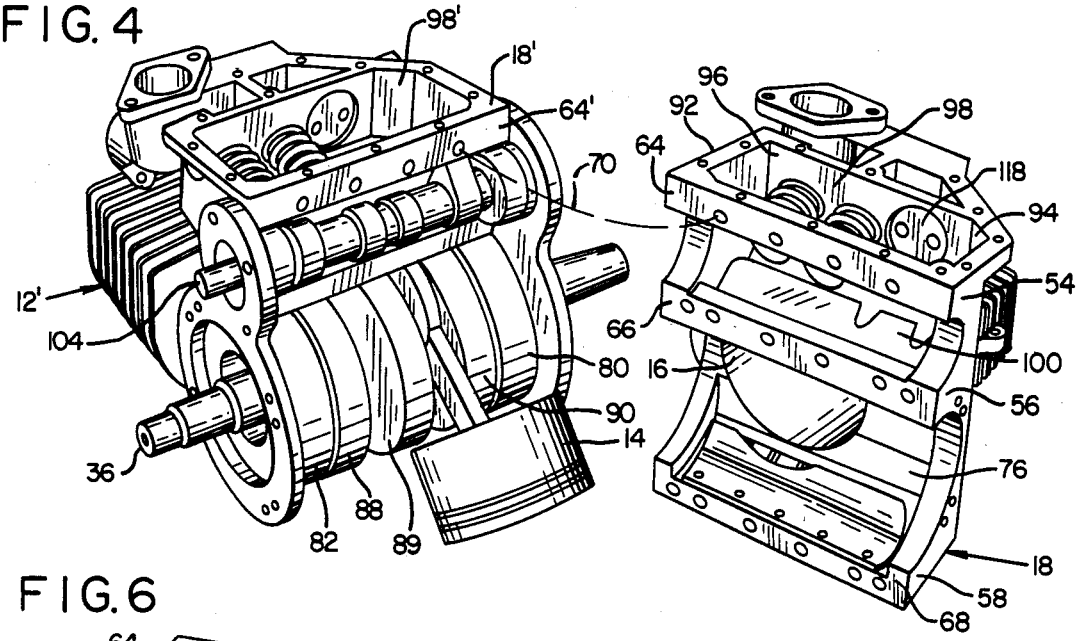
FIG. 4 is a pictorial view of the engine of FIG. 4, further disassembled.
Figure 6:
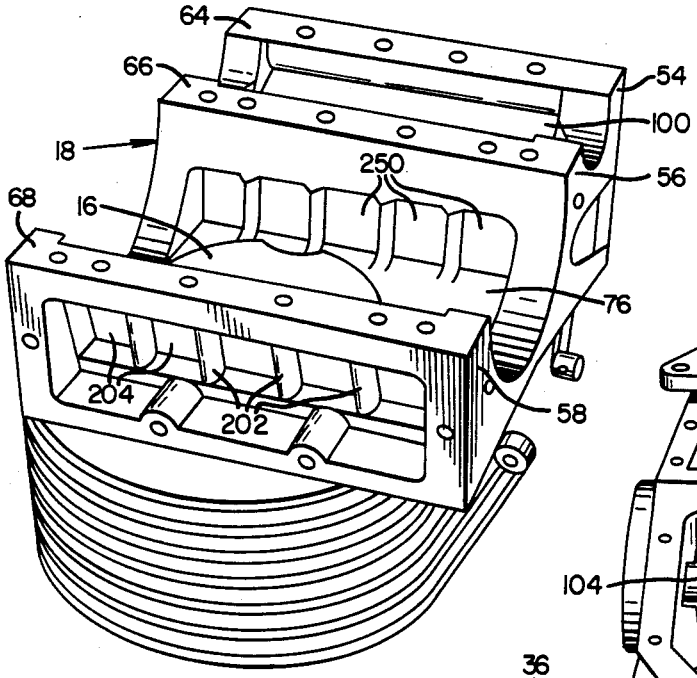
FIG. 6 is a pictorial view of an engine block in accordance with the instant invention.
Figure 5:
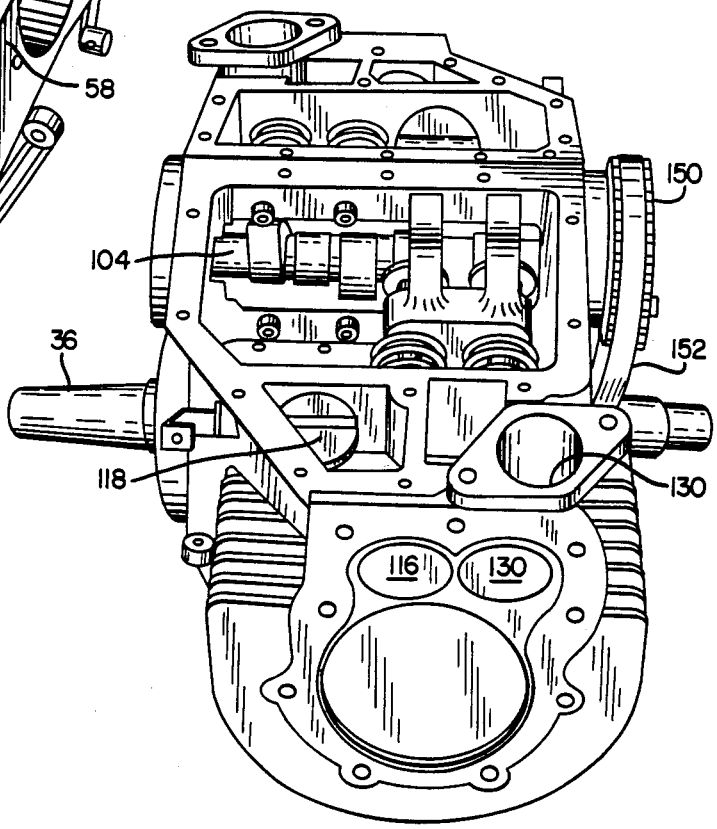
FIG. 5 is a pictorial view of the engine of FIG. 3, looking generally toward an end of one cylinder.
Figure 7:
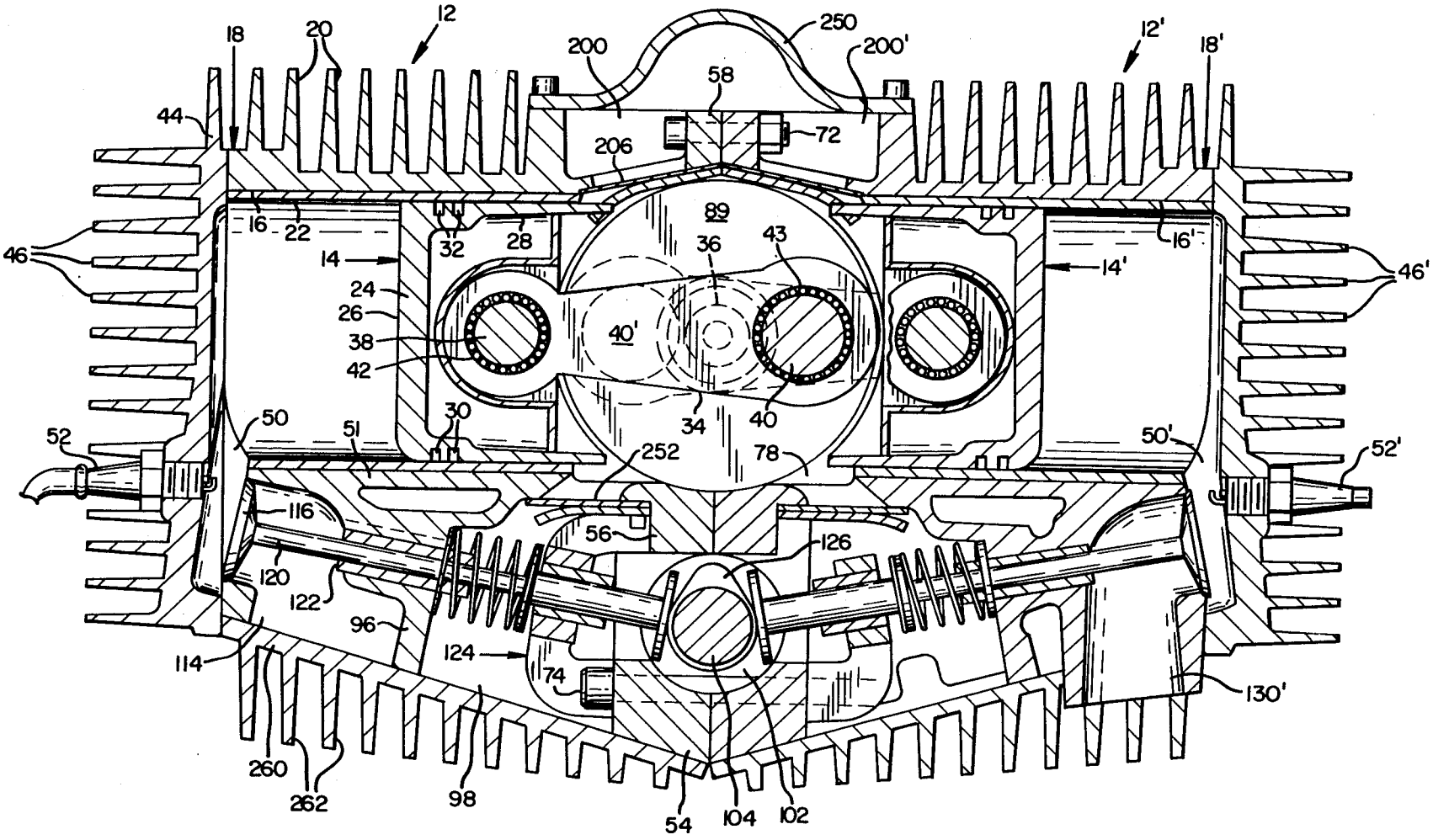
FIG. 7 is a section view of an engine in accordance with the present invention.

Referring now to the various views of the drawing for a more detailed description of the construction, operation and other features of the invention by characters of reference, FIGS. 1–8 show an internal combustion engine 10 which operates in the four-stroke (Otto) cycle and forms one embodiment of the present invention. Referring to FIGS. 1, 4 and 7, the engine 10, in its preferred embodiment, has two cylinder assemblies 12, 12' having pistons 14, 14' reciprocated in phase in horizontally opposed cylinders 16, 16'. The cylinders 16, 16' are formed in identical engine blocks 18, 18'. The engine blocks 18, 18' are alternatively termed "hemiblock" elements. To simplify the description, only one of the identical cylinder assemblies 12, 12' may be described in detail, like elements of the other cylinder assembly being referred to by like reference characters having a prime symbol.

The engine block 18 is case of aluminum alloy. The cylinder 16 is formed and machined in the engine block 18, with cooling fins 20 formed exteriorly of the cylinder 16. A thin, cylindrical barrel 22 of steel, hardened inside for resistance to wear, is inserted inside the cylinder 16 of the engine block. The piston 14 which is forged of 322 aluminum alloy comprises a piston head 24 having a face 26, and a side wall 28 with circumferential grooves 30 therein holding sealing rings 32. A connecting rod connects the piston 14 with a crankshaft 36. The connecting rod 34 is fastened to the piston 14 by a wrist pin 38, a cylindrical member anchored in thickened bosses (not shown) of the piston side wall 28. A crank pin 40, which is part of the crankshaft 36, anchors the connecting rod to the crankshaft 36, and bearings 42, 43 facilitate the swinging motion of the connecting rod 34.

A cylinder head 44 having cooling fins 46 is cast from high-strength aluminum alloy. The head 44, which is attached to the engine block 18 by cap screws 48, see FIG. 1, closes the cylinder 16 and forms therewith a combustion chamber 50 abaxial the cylinder 16 and cylinder wall 51 in L-head configuration. A spark plug 52 for igniting combustible working fluid in the combustion chamber 50 is mounted in the head 44.

Figure 8:
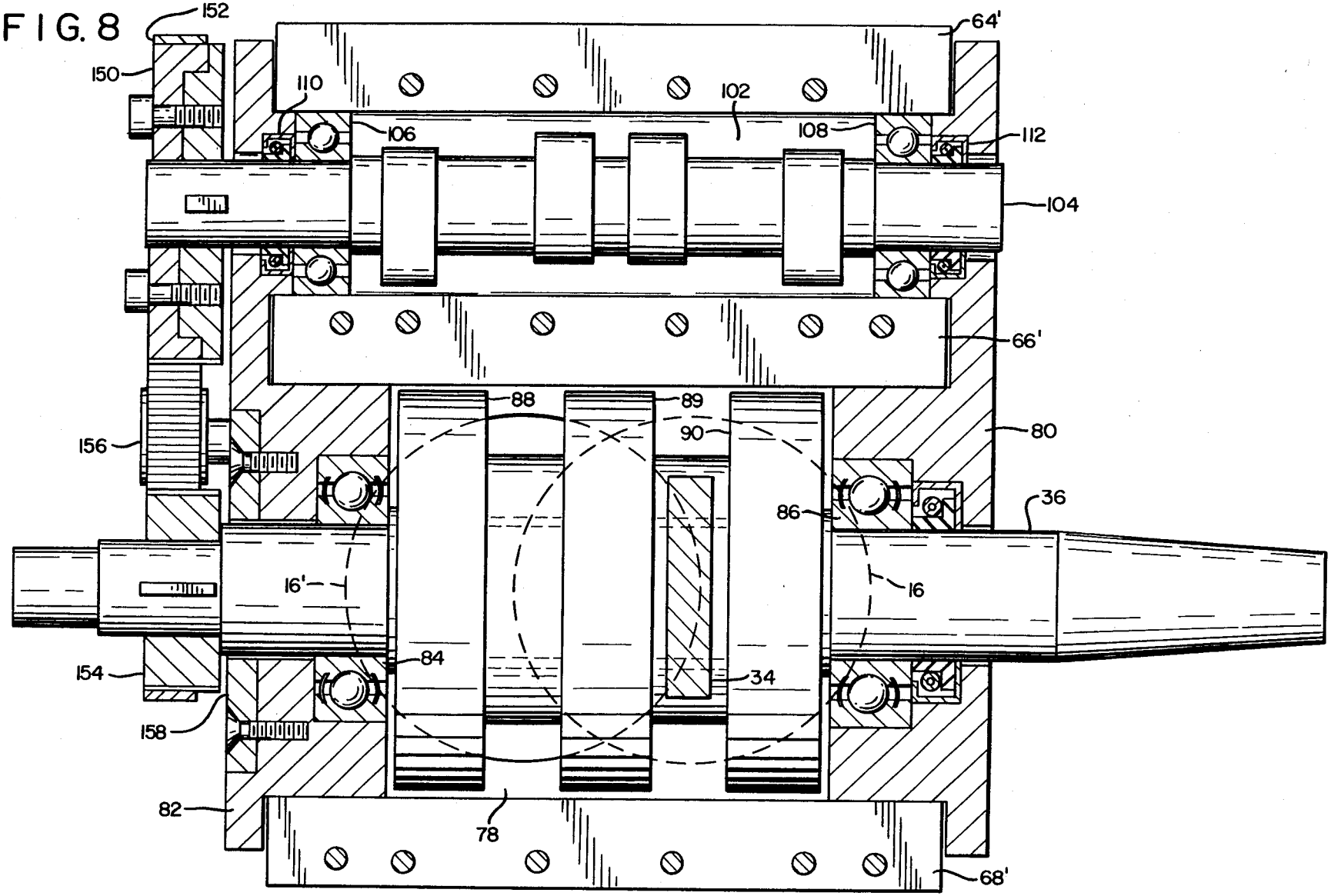
FIG. 8 is a modified plan view of one hemiblock assembly of an internal combustion engine in accordance with the present invention.

Referring now to FIGS. 4, 6 and 8, each of the hemiblock elements 18, 18' includes three structural members 54, 56, 58 having corresponding coplanar, symmetrical flanges 64, 66, 68 machined thereon. The structural members 54, 56, 58 are bored in a symmetrical pattern through the flanges 64, 66, 68 such that the bores and the flanges of one hemiblock element mate with corresponding mirror-image bores and flanges of the other hemiblock element, as illustrated by the dashed line 70 in FIG. 4, when the hemiblock elements are rotated with respect to each other with the cylinders horizontally opposed. Threaded fasteners such as through-bolts 72, 74 (FIG. 7) engaged through the mated bores, hold the engine hemiblock elements firmly joined together.

A semicylindrical chamber 76 having a longitudinal axis perpendicular to the cylinder 16 is formed in the hemiblock element 18 between the structural members 56, 58. When the hemiblock elements 18, 18' are joined as described supra, the semicylindrical chambers 72, 74' formed a cylindrical crankcase 78 open to both cylinders 16, 16'. Endplates 80, 82 having central apertures through which the crankshaft pass are fastened to the joined engine blocks at either end of the crankcase 78, the endplates closing the crankcase 78. Ball bearings 84, 86 pressed into internal recesses of the endplates 80, 82 receive journals of the crankshaft 36 for rotation therein. The volume of the crankcase 78 is reduced by counterweight stuffer disks 88–90 which form a part of the crankshaft 36 along with the crank pins 40, 40'. The crankpins 40, 40' space the disks 88–90 apart and receive the connecting rods 34, 34' therebetween. Dashed lines 16, 16' in FIG. 8 illustrate the locations of the cylinders with respect to each other and to the crankcase 78 and crankshaft 36, when the hemiblock elements 18, 18' are joined.

Referring to FIGS. 3–8, at the ends of the longitudinal structural members 54, 56, side walls 92, 94 of the engine hemiblock element 18 extend laterally with respect to the plane of the flanges 64, 66, and with an end wall 96 form a boost plenum or reservoir 98 alongside the cylinder wall 51. The boost plenum is open to a second semicylindrical chamber 100 extending longitudinally between the structural members 54, 56 and having an axis parallel with the axis of the first semicylindrical chamber 76. When the engine hemiblock elements 18, 18' are joined, the second semicylindrical chambers 100, 100' form a cylindrical housing 102 for a camshaft 104. The end plates 80, 82 close the camshaft housing 102 at either end thereof and hold bearings 106, 108 which receive journals of the camshaft 104. The camshaft housing 102 is sealed by seals 110, 112. An inlet port 114 opening to the combustion chamber 50 through an inlet valve 116 opens to the boost plenum 98 through a throttle valve 118. A stem 120 of the inlet valve 116 extends through a bronze valve guide 122 into the boost plenum 98. A camfollower assembly 124 mounted in the boost plenum operates the inlet valve 116 in a conventional manner in response to a cam 126 on the camshaft 104. Similarly, an exhaust port 130 opens into the combustion chamber 50 through an exhaust valve 132 which extends into the boost plenum 98. The exhaust port 130 structure is spaced apart from the boost plenum 98 to minimumize heat transfer.

A camshaft timing gear 150 keyed to the camshaft 104 is driven by a timing belt 152 from a timing gear 154 keyed to the camshaft 36. An idler pulley 156 is mounted for rotation on a ring 158 that is rotatably mounted to the end plate 82 to permit adjustment of timing belt 152 tension.

Figure 2:
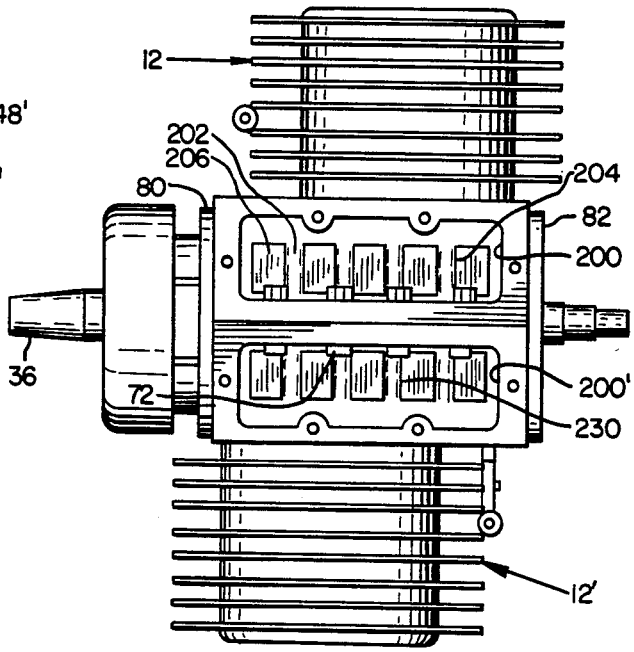
FIG. 2 is a top view of the engine of FIG. 1 with the carburetor assembly removed.
Figure 3:
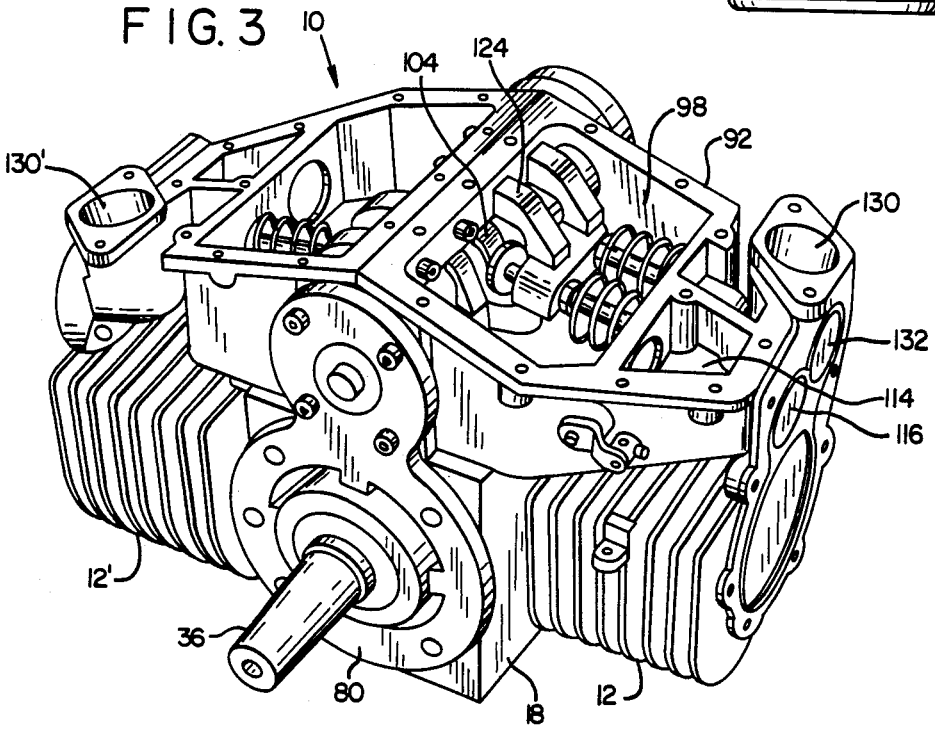
FIG. 3 is a pictorial view of the engine of FIG. 1, partially disassembled, and looking generally toward the bottom of the engine with respect to FIG. 1.

Referring to FIGS. 2, 4 and 6, the structure of the engine hemiblock element which forms the first semicylindrical chamber 76, includes an inlet chamber 200 extending longitudinally along the crankcase and a plurality of ribs 202 which form a corresponding longitudinal row of openings 204 between the inlet chamber 200 and the crankcase 78. The openings 204 are closed by reed valves 206 opening into the crankcase 78. A carburetor assembly 210 mounted on a cover plate 230 over the inlet plenums 200, 200' supplies combustible working fluid to the inlet plenum 200. A similar longitudinal row of openings 250 having reed valves 252 opening into the boost plenum 98 is formed in the engine hemiblock element between the crankcase 78 and the boost plenum 98. The boost plenum 98 and the inlet port 114 are closed by a cover 260 having cooling fins 262.

On each upstroke of the pistons, combustible working fluid such as an air-gasoline mixture is drawn into the crankcase through the reed valves 206. On each downstroke of the pistons, the working fluid is compressed in the crankcase and discharged through the reed valves 252 into the boost plenum 98. On alternate downstrokes of the piston 14 the inlet valve 116 is opened introducing working fluid into the combustion chamber 50.

Figure 9:
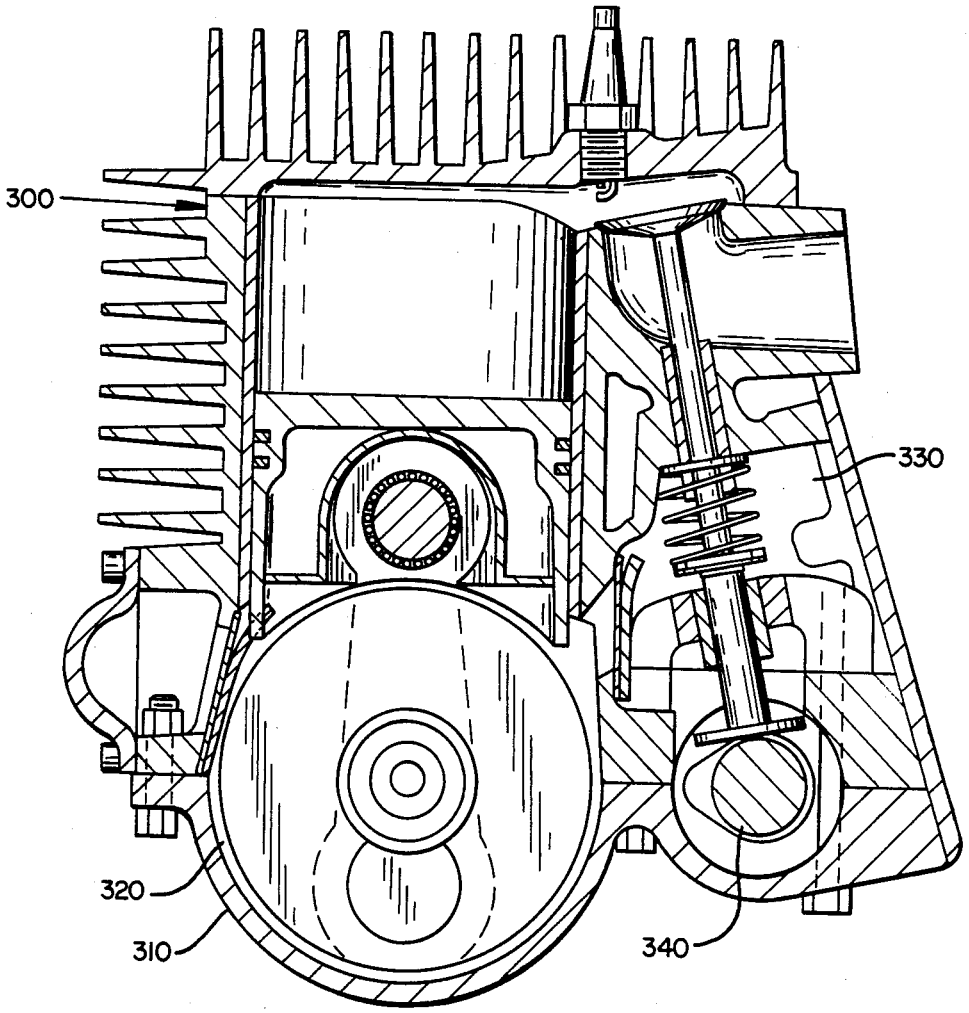
FIG. 9 is a section view of a one-cylinder embodiment of an internal combustion engine in accordance with the instant invention.

Referring to FIG. 9, an alternative embodiment of the invention utilizing a single engine hemiblock element 300 is shown. The engine block 300 is identical with the hemiblock elements previously described with reference to FIGS. 1–8. A closure 310 bolted to the three coplanar flanges of the engine block encloses the crankcase 320 and the boost plenum 330 which also houses the camshaft 340, thereby forming a one-cylinder embodiment of the invention.

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. A four-stroke cycle internal combustion engine, comprising:

an engine block;

a cylinder defined in said engine block;

a piston having a cylindrical sleeve and a face closing one end of the sleeve, said piston being slidably received and reciprocally movable in said cylinder;

a head closing said cylinder and defining a combustion chamber with at least a portion of the face of said piston;

an exhaust port formed in said engine block and opening into the combustion chamber;

an exhaust valve closing the opening into the combustion chamber from the exhaust port;

an inlet port formed in said engine block and opening into the combustion chamber;

an inlet valve closing the opening into the combustion chamber from the inlet port;

said engine block having walls which define a first semicylindrical chamber, the cylinder opening into into the first semicylindrical chamber;

a crankshaft journaled in the first semicylindrical chamber, said crankshaft having an axis essentially perpendicular with an axis of said piston a first closure enclosing said crankshaft in the first semicylindrical chamber of said engine block and forming therewith an enclosed crankcase;

a connecting rod coupling said piston to said crankshaft, said piston driving said crankshaft;

a second chamber defined in said engine block and extending along a side of the cylinder, said inlet valve and said exhaust valve each having a stem extending into said second chamber, said inlet port having an opening into said second chamber;

said engine block having a second closure forming a reservoir within said second chamber;

a throttle valve mounted in said engine block in an opening between the inlet port and the reservoir;

a camshaft journaled in said engine block at one end of the reservoir, said camshaft having an axis essentially parallel with the axis of said crankshaft, said camshaft being coupled to said crankshaft to operate said inlet valve and said exhaust valve in the four-stroke cycle, said reservoir surrounding said camshaft in the second closure;

said engine block having an inlet passage formed in a wall defining the crankcase, and an outlet passage formed in a wall between the crankcase and the reservoir, said passages extending longitudinally with respect to the semicylindrical chamber forming a length of the crankcase to be substantially that of the crankcase, each of said passages having mounted therein a valve body including a plurality of reed-valve members in normal positions closing the passages and movable by pressure to positions opening the passages; and means for supplying working fluid to the inlet passage of the crankcase, the working fluid being forced into the crankcase during an upstroke of said piston and compressed in the crankcase during a downstroke of said piston, the compressed working fluid being forced from the crankcase into the reservoir during each said downstroke, and into the combustion chamber under control of said intake valve and said throttle valve during intake downstrokes of said piston.

2. The internal combustion engine as claimed in claim 1, wherein said first closure comprises a second engine block identical with said first engine block and rotated 180 degrees with respect to said first engine block around a line in the same plane and normal to the axes of said crankshaft and said camshaft, and further comprising:

a second piston driving said crankshaft and slidably engaged in a cylinder defined in said second engine block, the second piston and the cylinder of said second engine block being longitudinally opposed to said piston and the cylinder of said first engine block, the reservoir of said first engine block being contiguous and in common with a reservoir of said second engine block.

3. A four-stroke cycle internal combustion engine, comprising:

a first engine block having a cylinder and a first semicylindrical chamber perpendicular to said cylinder formed therein;

a crankshaft journaled in said first semicylindrical chamber;

a closure forming an enclosed crankcase with said first semicylindrical chamber;

a piston slidably engaged for reciprocation in said cylinder;

a connecting rod connecting said piston to said crankshaft;

a cylinder head attached to said engine block and forming a combustion chamber with said cylinder and said piston;

a boost plenum formed in said engine block adjacent said cylinder, said boost plenum communicating with said enclosed crankcase;

a camshaft journaled in and surrounded by said boost plenum;

means for introducing combustible working fluid into said crankcase during each upstroke of said piston, said combustible working fluid being compressed in said crankcase during each downstroke of said piston;

means for discharging the compressed working fluid from said crankcase into said boost plenum near completion of each said downstroke; and means housed in said boost plenum and operated by said camshaft for introducing the compressed working fluid in said boost plenum into said combustion chamber on alternate downstrokes of said piston.

4. The internal combustion engine of claim 3, wherein said closure comprises a second engine block identical with said first engine block and rotated with respect to said first engine block to form a two-cylinder engine with horizontally opposed cylinders, a boost plenum of the second engine block being in common with the boost plenum of the first engine block, said camshaft being centrally disposed in said common boost plenum.

5. The internal-combustion engine of claim 3 wherein said means for introducing the compressed working fluid in said boost plenum into said combustion chamber on alternate downstrokes of said piston comprises a valve having a stem extending into said boost plenum, and a cam-follower assembly coupling said valve to said camshaft.

6. The internal-combustion engine of claim 4 wherein said means for introducing the compressed working fluid in said boost plenum into each said combustion chamber on alternate downstrokes of said piston corresponding therewith comprises a valve having a stem extending into said boost plenum, and a cam-follower assembly coupling said valve to said camshaft.

* * * * *